US008608204B2

(12) United States Patent
Brennan et al.

(10) Patent No.: US 8,608,204 B2
(45) Date of Patent: Dec. 17, 2013

(54) TAGS

(75) Inventors: Paul Anthony Brennan, Skipton (GB); Michael David Moorhouse, Bradford (GB)

(73) Assignee: Brennoor Ltd., West Yorkshire (GB)

( * ) Notice: Subject to any disclaimer, the term of this patent is extended or adjusted under 35 U.S.C. 154(b) by 0 days.

(21) Appl. No.: 13/241,842

(22) Filed: Sep. 23, 2011

(65) Prior Publication Data

US 2012/0248757 A1 Oct. 4, 2012

(30) Foreign Application Priority Data

Apr. 4, 2011 (GB) ..... 110564

(51) Int. Cl.
*B42D 15/00* (2006.01)
*B42D 15/10* (2006.01)

(52) U.S. Cl.
USPC ..... 283/81; 283/67; 283/70; 283/72; 283/74; 283/94; 283/98; 283/100; 283/101; 283/105; 283/107; 283/108

(58) Field of Classification Search
USPC ..... 283/67, 70, 72, 74, 81, 94, 98, 100, 283/101, 105, 107, 108
See application file for complete search history.

(56) References Cited

U.S. PATENT DOCUMENTS 4,557,971 A * 12/1985 Williams ..... 283/81
6,082,777 A * 7/2000 Grosskopf et al. ..... 283/81
6,364,990 B1 * 4/2002 Grosskopf et al. ..... 283/81

* cited by examiner

*Primary Examiner* — Dana Ross
*Assistant Examiner* — Justin V Lewis

(57) ABSTRACT

A self attaching tag made essentially of self adhesive printable plastic to be attached to a fragile and easily deformable object characterized in that the tag is covered with a plurality of varnishes which allow for the protection of pre-printing and for printing and writing on at the moment of use. The tags are delivered on large rolls where perforations allow for easy separation of the tags.

7 Claims, 1 Drawing Sheet

TAGS

BACKGROUND OF THE INVENTION

This invention relates to an improvement to tags, the sort of tags that are, for example, attached to hospital fluid bags, such as blood bags, saline solution bags and the like. To be able to identify any one bag and match it to a particular patient or operation, a tag has to be attached since the bag itself may not be tampered with or written upon. The tag is pre-printed with all the information required to identify the patient, operation and contents of the bag it is meant to be attached to.

Such tags are well known in the medical field and have been used for quite some time. However, there are drawbacks to the presently available tags. They are supplied either part printed for attaching to the fluid bags they are ordered for, supplied largely blank for writing on, or a self adhesive label is printed and adhered to a luggage style tag. All these forms of identification are then secured to the fluid bag by different methods such as cable tie, nylon attachment or string.

SUMMARY OF THE INVENTION

This invention alleviates the above problem by creating one single tag which can be attached to the bag without using additional items to secure it, can be printed with patient demographic using heat, ink or ribbon and later further marked by hand with a ball point pen. This is achieved by creating a self adhesive section for sticking back on itself, covering the whole tag with special varnish coatings which combine the properties required for a writing/printing surface with the properties that can protect a heat sensitive chemical layer that is coated onto the material in its raw state. The new coatings are applied in two successive layers.

Layer 1 consists of a clear liquid applied at a controlled volume to thickness ensuring resistance to Isopropyl alcohol at 70% (Code L508 supplied by Paragon Inks) and layer 2 consists of a clear matt low viscosity liquid (Code EL095 supplied by Pulse Inks) which is applied at a controlled volume to thickness to insure receptiveness to ball point pen ink laser printing.

The raw tags are made of a polypropylene or polyethylene base, covered with adhesive and a liner such as Honey or White Glassine™. They then have the two coatings applied and are supplied in rolls of several hundred, fully shaped and perforated for separation from each other and for division into smaller stick-on labels for imparting the information printed or written on those parts on to different surfaces, such as patient notes or diagnostic sheets.

By (pre)printing the correct demographic in addition to the fact that they can be hand written and then coupled with the above mentioned attaching methods, the flexibility of use of these labels is dramatically increased.

DETAILED DESCRIPTION OF THE PREFERRED EMBODIMENT

Figures 1, 2:
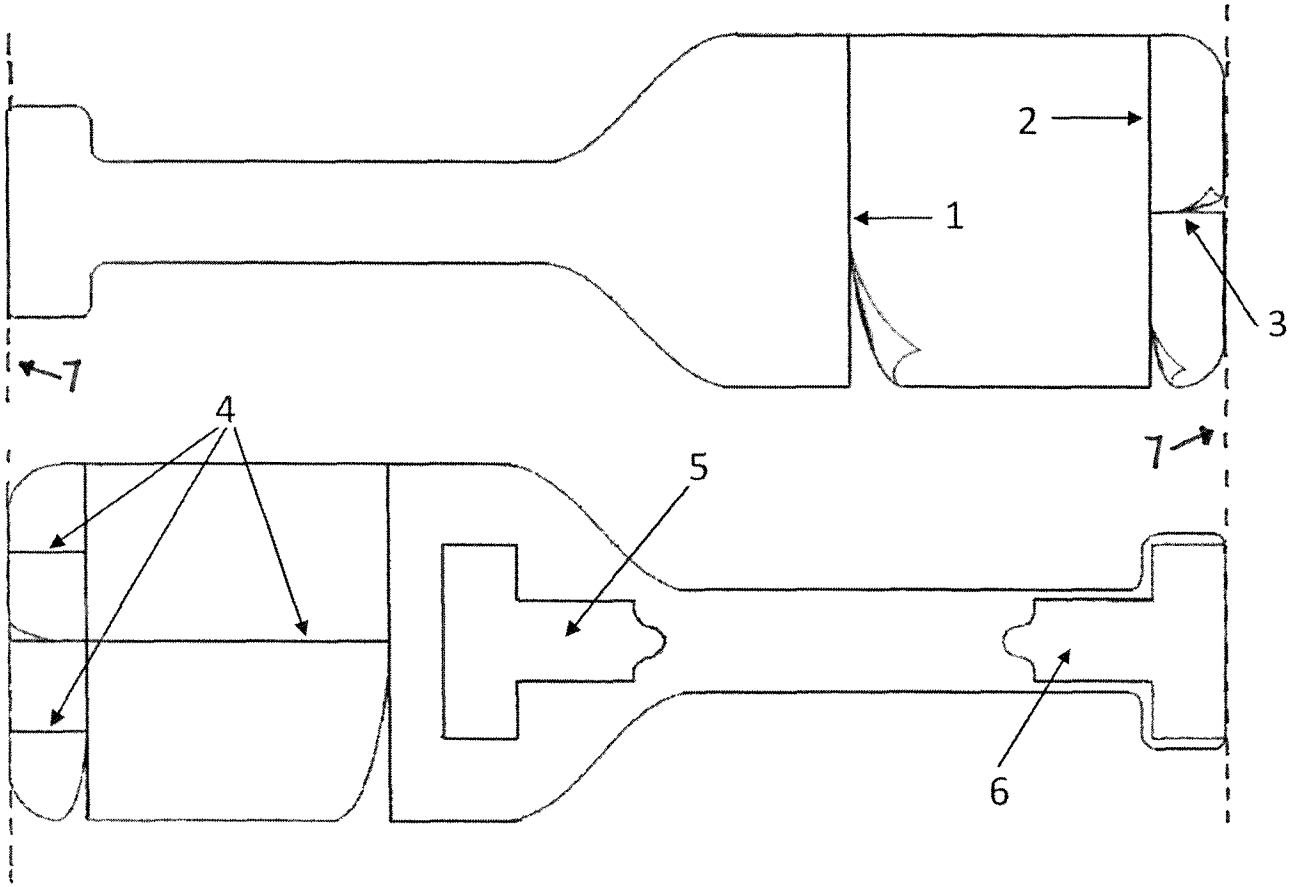
FIG. 1 illustrates the front of the tag.
FIG. 2 shows the back of the same tag.

The invention is illustrated by FIGS. 1 and 2. FIG. 1 shows the front view of the new label. Lines (1), (2) and (3) indicate perforations by means of which the tag can be split into smaller parts, possibly indicating usage of the bag or for transferring part of the information to a different data recording system such as patients' notes. Alternatively, the tags may be produced without perforations with only peel-off labels which leave the tag in its initial size and shape.

FIG. 2 shows the back of the tag. Lines (4) indicate score lines allowing the label surface to be separated from its base for sticking onto a different surface such as a piece of paper in patients' notes. Porting (6) has a removable section to expose an adhesive underside. This part can then be folded back to be sealed against the marked portion (5) after feeding portion (6) through an attachment hole on a fluid bag. This way the means for attaching the tag to the bag are integral with the tag and no additional fixing means are required.

Unless otherwise required, the label comes in the size indicated but different sizes are, of course, possible and are not limiting to the invention.

The invention claimed is:

1. A self-attaching tag made essentially of self-adhesive printable plastic to be attached to a fragile and easily deformable object such as a blood bag or other pharmaceutical fluid, said tag being of a total length of substantially 240 mm and comprising three parts, the first part being an oblong shaped main body of substantially 70 mm in width and longer in length, the second part comprising sloping shoulders which reduce the width of the tag gradually down to the third part which is essentially an attachment strip and comprises a T-shaped end which, when doubled back over said sloping shoulders part, forms an attachment loop to be attached to the blood bag, the whole tag being a laminate of six layers with layer one being a standard carrier layer, layer two being an adhesive and layer three a film layer, layer four being a thermo sensitive chemical which supports thermal printing of text, images or barcode on it, layer five protects that printing from deterioration and finally layer six allows, at the moment of use, writing on with standard ballpoint pen.

2. A tag according to claim 1 wherein attachment strip comprises an area of adhesive to be exposed by peeling off a protective layer, and folded back onto a marked sealing area on the tag.

3. A tag according to claim 1 wherein the main body of the tag includes sticky labels that can be peeled off and/or completely separated from the tag.

4. A tag according to claim 1 wherein the pre-printing can be done by burning, thermal ribbon, inkjet printing or laser printing.

5. A tag according to claim 1, which is to be attached to said fluid bag containing blood, saline, drugs, food supplements or plasma solutions.

6. A roll of tags according to claim 1, wherein the tags are fully finished and ready for use except for possible additional over printing and/or handwriting.

7. A roll of tags according to claim 6 wherein rolls of tags are pre-perforated for easy separation of the tags from each other.

* * * * *